US010143246B2

(12) United States Patent
Houde et al.

(10) Patent No.: US 10,143,246 B2
(45) Date of Patent: Dec. 4, 2018

(54) METHOD FOR CUTTING AND PLACING NOSE WIRES IN A FACEMASK MANUFACTURING PROCESS

(71) Applicant: O&M Halyard, Inc., Mechanicsville, VA (US)

(72) Inventors: Ajay Y. Houde, Duluth, GA (US); David Lamar Harrington, Cumming, GA (US); Mark Thomas Pamperin, Cumming, GA (US); Nathan Craig Harris, Canton, GA (US); Joseph P. Weber, Suwanee, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 167 days.

(21) Appl. No.: 15/307,534

(22) PCT Filed: Oct. 16, 2015

(86) PCT No.: PCT/US2015/055865

§ 371 (c)(1),
(2) Date: Oct. 28, 2016

(87) PCT Pub. No.: WO2017/065786

PCT Pub. Date: Apr. 20, 2017

(65) Prior Publication Data

US 2018/0042315 A1 Feb. 15, 2018

(51) Int. Cl.
*B65H 51/20* (2006.01)
*B65H 51/30* (2006.01)
(Continued)

(52) U.S. Cl.
CPC ..... *A41D 13/11* (2013.01); *B65H 49/34* (2013.01); *B65H 51/20* (2013.01); *B65H 51/30* (2013.01);
(Continued)

(58) Field of Classification Search
CPC ..... Y10T 83/483–83/4844; Y10T 83/7851; Y10T 83/8759; Y10T 83/6635;
(Continued)

(56) References Cited

U.S. PATENT DOCUMENTS 3,670,474 A 6/1972 Vieson et al.
3,847,046 A 11/1974 Schmermund
(Continued)

FOREIGN PATENT DOCUMENTS

CA 2 325 975 A1 5/2002
CN 104872866 A 9/2015
(Continued)

OTHER PUBLICATIONS

International Search Report and Written Opinion, dated Jun. 2, 2016, 11 pages.

*Primary Examiner* — Timothy Stanis
(74) *Attorney, Agent, or Firm* — Dority & Manning, P.A.

(57) ABSTRACT

A method and system are provided for cutting and placing individual nose wires in a facemask production line. A continuous wire is supplied from a source to a cutting station in the production line. At the cutting station, the wire is engaged with a set of driven feed rollers that advance the wire at a first speed to a cutting roller, wherein the wire is cut into individual nose wires. The individual nose wires from the cutting roller are then engaged by a set of delivery rollers to deposit the individual nose wires onto a running carrier web. The delivery rollers are independently driven relative to the feed rollers and cutting roller such that the nose wires from the cutting roller are initially accelerated and transported away from the cutting roller at a second speed that is greater than the first speed and then decelerated and moved onto the carrier web at a third speed that is less than the first speed.

6 Claims, 4 Drawing Sheets

(51) Int. Cl.
*A41D 13/11* (2006.01)
*B65H 49/34* (2006.01)

(52) U.S. Cl.
CPC ..... *B65H 2701/36* (2013.01); *Y10T 83/664* (2015.04); *Y10T 83/6644* (2015.04)

(58) Field of Classification Search
CPC ..... Y10T 83/664; Y10T 83/6644; Y10T 83/2196; Y10T 83/6654; Y10S 83/95
USPC ..... 83/343–349, 505–506, 436.1, 436.5, 83/436.3, 436.6, 436.9, 950, 110, 403.1
See application file for complete search history.

(56) References Cited

U.S. PATENT DOCUMENTS

| | | | | |
|---|---|---|---|---|
| 3,983,774 | A | 10/1976 | Seragnoli | |
| 4,640,164 | A * | 2/1987 | Pavlov | B23D 25/12 83/154 |
| 5,117,614 | A | 6/1992 | Johnsen | |
| 5,155,967 | A | 10/1992 | Branson | |
| 5,170,610 | A | 12/1992 | Tisma | |
| 5,322,061 | A | 6/1994 | Brunson | |
| 5,724,677 | A | 3/1998 | Bryant et al. | |
| 5,727,369 | A | 3/1998 | Mosse | |
| 6,173,712 | B1 | 1/2001 | Brunson | |
| 6,174,397 | B1 | 1/2001 | Johnson | |
| 6,524,423 | B1 | 2/2003 | Hilt et al. | |
| 6,729,103 | B1 | 5/2004 | Hartness et al. | |
| 7,703,260 | B1 | 4/2010 | Watkins | |
| 2002/0095913 | A1 | 7/2002 | Honegger | |
| 2004/0144619 | A1 | 7/2004 | Ohiro et al. | |
| 2004/0262127 | A1 | 12/2004 | Harnish et al. | |
| 2006/0070353 | A1 | 4/2006 | Van Dam | |
| 2008/0072721 | A1 | 3/2008 | Kern | |
| 2008/0251210 | A1 | 10/2008 | Chen | |

FOREIGN PATENT DOCUMENTS

| | | | |
|---|---|---|---|
| CN | 104939377 | A | 9/2015 |
| DE | 3736868 | A1 | 5/1989 |
| EP | 0 622 298 | A1 | 11/1994 |
| EP | 0 640 526 | A1 | 3/1995 |
| EP | 0 791 537 | A1 | 8/1997 |
| EP | 0 806 343 | A2 | 11/1997 |
| EP | 0 894 752 | A1 | 2/1999 |
| EP | 1 048 595 | A1 | 11/2000 |
| EP | 2 484 611 | A2 | 8/2012 |
| EP | 2 801 790 | A1 | 11/2014 |
| FR | 1588621 | A | 4/1970 |
| GB | 364557 | | 12/1931 |
| GB | 2 092 090 | A | 8/1982 |
| JP | 2011-178459 | A | 9/2011 |
| KR | 100550225 | | 2/2006 |
| WO | WO 97/32494 | | 9/1997 |

* cited by examiner

-Prior Art-

-Prior Art-

-Prior Art-

METHOD FOR CUTTING AND PLACING NOSE WIRES IN A FACEMASK MANUFACTURING PROCESS

FIELD OF THE INVENTION

The present invention relates generally to the field of protective facemasks, and more specifically to a method and system for cutting and placing nose wires in the manufacturing process of such facemasks.

FAMILY OF RELATED APPLICATIONS

The present application is related by subject matter to the following concurrently filed PCT applications (all of which designate the US):

a. International Application No.: PCT/US2015/055858; entitled "Method and System for Splicing Nose Wire in a Facemask Manufacturing Process".

b. International Application No.: PCT/US2015/055861; entitled "Method and System for Splicing Nose Wire in a Facemask Manufacturing Process".

c. International Application No.: PCT/US2015/055863; entitled "Method and System for Introducing a Reserve Nose Wire in a Facemask Production Line".

d. International Application No.: PCT/US2015/055867; entitled "Method and System for Placing Nose Wires in a Facemask Manufacturing Process".

e. International Application No.: PCT/US2015/055871; entitled "Method and System for Placing Nose Wires in a Facemask Manufacturing Process".

f. International Application No.: PCT/US2015/055872; entitled "Method and System for Placing Nose Wires in a Facemask Manufacturing Process".

g. International Application No.: PCT/US2015/055876; entitled "Method and System for Wrapping and Preparing Facemasks for Packaging in a Facemask Manufacturing Line".

h. International Application No.: PCT/US2015/055878; entitled "Method and System for Automated Stacking and Loading Wrapped Facemasks into a Carton in a Facemask Manufacturing Line".

i. International Application No.: PCT/US2015/055882; entitled "Method and System for Automated Stacking and Loading of Wrapped Facemasks into a Carton in a Facemask Manufacturing Line".

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool in a continuous in-line process cutting and crimping process and then laid directly onto a running carrier nonwoven web (which may include a plurality of nonwoven layers) along an edge that becomes a top edge of the finished mask. The edge is subsequently sealed with a binder material, which also encapsulates and permanently holds the nose wire in place at the top edge. Transport and placement of the individual nose wires from the cutting/crimping station onto the carrier web must be precise to ensure the correct location of the nose wires in the finished face masks. For mass production of facemasks at the throughputs mentioned above, the production rates (throughput) of the individual nose wires from the cutting/crimping station and transport speed of the carrier web will necessarily be significantly higher as compared to conventional manufacturing lines. Consequently, it is believed that more precise control and placement of the nose wires from the cutting/crimping station onto the carrier web will be needed to ensure proper placement of the nose wires prior to the encapsulation process.

The present invention addresses this need and provides a method and system for high speed cutting and placement of nose wires on the running carrier web in an in-line manufacturing process of facemasks.

SUMMARY OF THE INVENTION

Objects and advantages of the invention will be set forth in the following description, or may be obvious from the description, or may be learned through practice of the invention.

In accordance with aspects of the invention, a method is provided for cutting individual nose wires from a continuously supplied wire and placing the nose wires onto a carrier web in a facemask production line at rates significantly greater than with conventional production lines. It is believed that the present cutting and placement method will support facemask production rates in a single production line of at least a magnitude greater than conventional lines.

It should be appreciated that the present inventive method is not limited to any particular style or configuration of facemask that incorporates a nose wire, or to the downstream facemask production steps.

The method includes supplying a continuous wire from a supply source to a cutting station in the facemask production line. At the cutting station, the wire is engaged with a set of driven feed rollers and advanced by the feed rollers at a first speed to a cutting roller. At the cutting roller, the wire is cut into individual nose wires having a predetermined length. The individual nose wires emerging from the cutting roller are engaged by a set of delivery rollers, which advance and deposit the individual nose wires onto a running carrier web. In accordance with aspects of the invention, the delivery rollers are independently driven relative to the feed rollers and cutting roller such that the nose wires from the cutting roller are initially accelerated and transported away from the cutting roller at a second speed that is greater than the first speed. The individual nose wires are then decelerated by the delivery rollers and moved onto the carrier web at a third speed that is less than the first speed.

In a certain embodiment, the feed rollers are independently driven relative to the cutting roller and the delivery rollers. In addition, the cutting roller may be independently driven relative to the feed rollers and the delivery rollers. The feed rollers, the cutting roller, and the delivery rollers may have independent controllable drives that are controlled by a controller.

In a particular embodiment, the wire is supplied from a driven roll source having a drive that is independent from the feed rollers drive and is controlled by the controller to transport the wire to the feed rollers at a fourth speed that is greater than the first speed so as to form an accumulation of the wire between the roll source and the feed rollers. This accumulation prevents drag at the feed rollers and allows precise transport speed of the wire by the feed rollers to the cutting roller.

For control purposes and to achieve the speed differentials mentioned above, the method may further include sensing rotational speed of the feed rollers and the delivery rollers with sensors that are in communication with the controller.

The present invention also encompasses various system embodiments for cutting individual nose wires from a continuously supplied wire and placing the nose wires onto a carrier web in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relate to cutting individual nose wires from a continuously supplied wire, and placing the individual nose wires onto a carrier web in a facemask production line. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
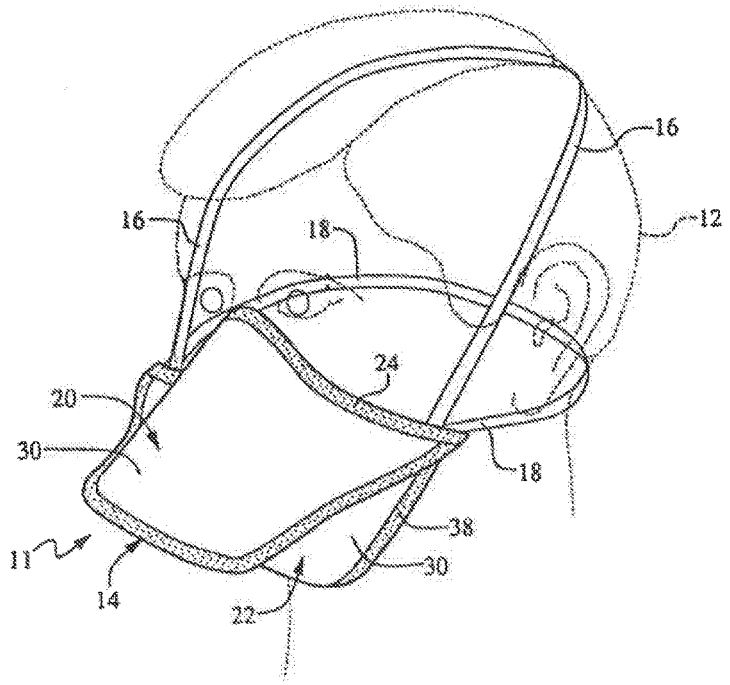
FIG. 1 is a perspective view of a conventional respiratory facemask worn by a user, the facemask incorporating a nose wire to conform the facemask to the user's face.
Figure 2:
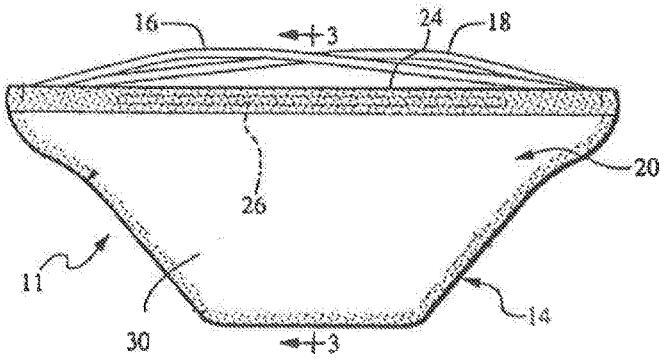
FIG. 2 is a top view of the conventional facemask of FIG. 1 is a folded state.
Figure 3:
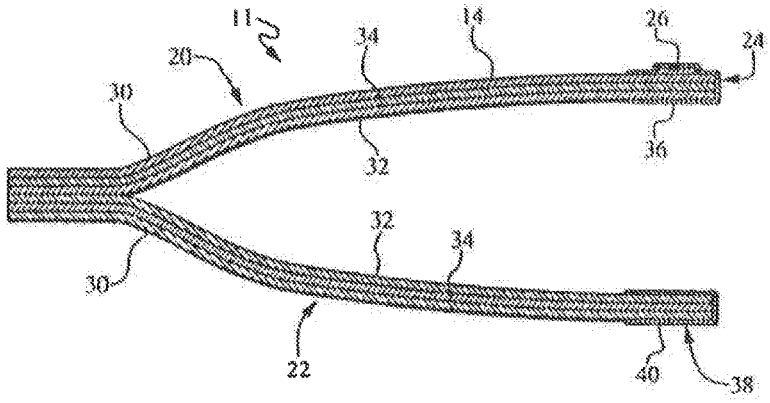
FIG. 3 is a cross-sectional view of the facemask of FIG. 2 taken along the lines indicated in FIG. 2.

Referring to FIGS. 1-3, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 are one or more intermediate filtration layers 34. This layer is typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
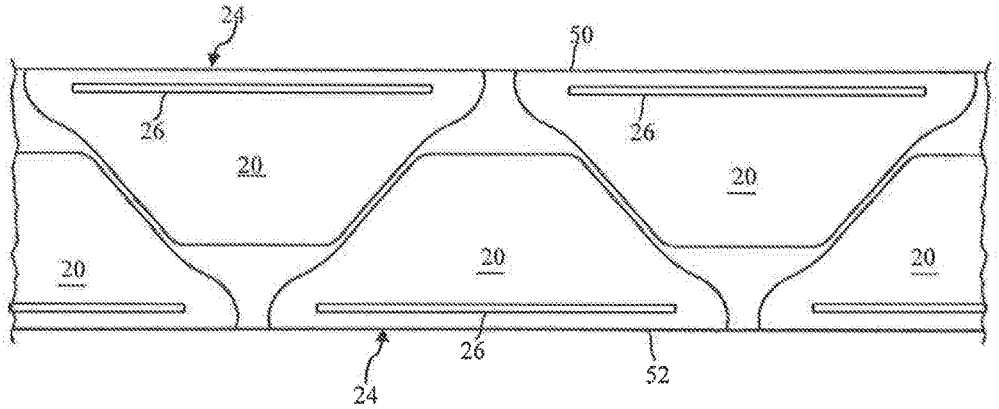
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap may be formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
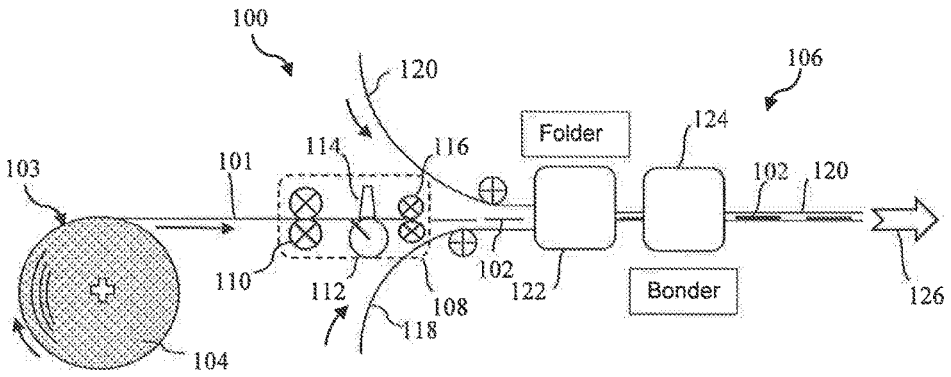
FIG. 5 is a schematic depiction of parts of a facemask production line in accordance with aspects of the invention related to feeding, cutting, and placing of nose wires for subsequent incorporation with facemask panels.
Figure 6:
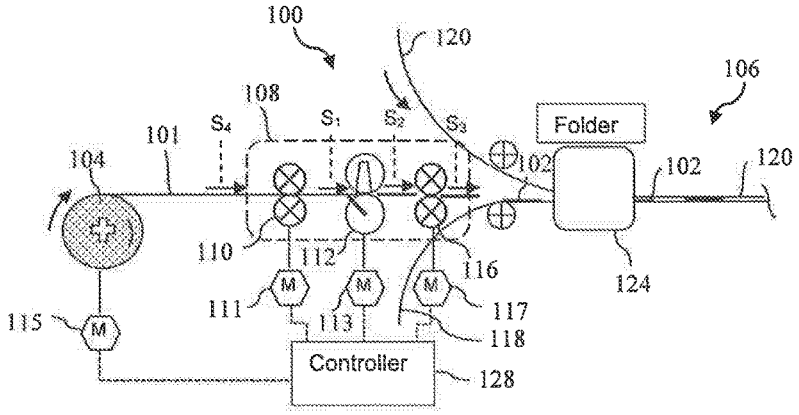
FIG. 6 is a schematic representation of aspects for cutting and placing nose wires into a running production line in accordance with aspects of the invention.

FIG. 5 depicts portions of a production line 106 for facemasks that incorporate a nose wire 26 (FIG. 4). A continuous wire 101 is supplied in strip form from a source 103. In a particular embodiment, this source is a roll 104 of the wire which may be rotationally driven by motor 115 (FIG. 6). The continuous wire 101 is conveyed to a cutting station 108 that is particularly configured in accordance with aspects of the present methods.

Referring to FIGS. 5 and 6, the cutting station 108 includes a set of feed rollers 110 that define a driven nip, wherein one of the feed rollers is driven and the other may be an idler roll. A dedicated motor 111 is operationally configured with the driven feed roller 110 and is in communication with a controller 128. The feed roller 110 may also serve to impart a crimped pattern to the running nose wire 101, such as diamond pattern. From the feed rollers 110, the wire 101 is fed to a cutter roller 112 configured opposite to a stationary or rotationally driven anvil 114. A dedicated motor 113 is operationally configured with the cuter roller 112 and is in communication with the controller 128. The cutter roll 112 cuts the continuous wire 101 into individual nose wires 102 having a predetermined length. From the cuter roller 112, the individual nose wires 102 are engaged by a pair of delivery rollers that transport the individual nose wires 102 from the cutting station 108 onto a carrier web 118. A dedicated motor 117 is operationally configured with the driven delivery roller 116 and is in communication with the controller 128. Referring to FIG. 4, the carrier web 118 may be the continuous multi-layer web that defines the upper and lower body portions 20, 22, wherein the individual nose wires 26 are deposited along the edge of the carrier web 118 corresponding to the top edge 24. It should be appreciated that an additional cutting station may be operationally disposed opposite to (and upstream or downstream) of the cutting station 108 for cutting and placing the nose wires on the opposite nested upper body portions 20 in the web depicted in FIG. 4. For the sake of ease of understanding only one such cutting station is illustrated and described herein.

After placement of the individual nose wires 102 in position on the carrier web 118, the binder web 120 is introduced to the production line along both edges of the carrier web 118 (only one binder web 120 is depicted in FIG. 5.). The combination of carrier web 118, nose wires 102, and binder webs 120 pass through a folding station 122 wherein the binder webs 120 are folded around the respective running edges 50, 52 of the carrier web 118 (FIG. 4). The components then pass through a bonding station 124 wherein the binder webs 120 are thermally bonded to the carrier web 118, thereby producing the edge configurations 24, 38 depicted in FIG. 3 with respective binders 36, 40. The nose wire 26 is held in position relative to the top edge 24 by the binder 36.

From the bonding station 124, the continuous combination of carrier web 118 with nose wires 102 under the binder 36 is conveyed to further downstream processing stations 126 wherein the individual facemasks are cut, bonded, head straps are applied, and so forth.

Figure 7:
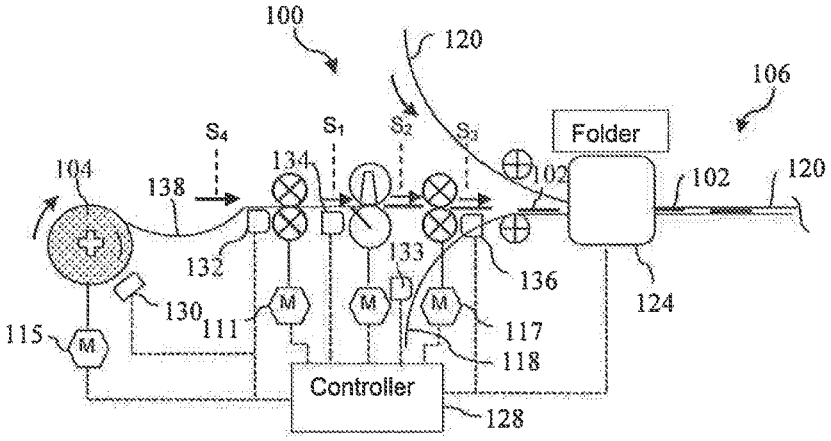
FIG. 7 is a schematic representation of further aspects for cutting and placing nose wires into a running production line in accordance with aspects of the invention.

With further reference to FIGS. 5 through 7, aspects of a method 100 are depicted for cutting the continuous wire 101 and placing the individual nose wires 102 onto the carrier web 118 in a manner that supports significantly greater facemask production rates from the production line 106. As mentioned, it is believed that the present cutting and placement method 100 will support facemask production rates in a single production line 106 of at least a magnitude greater than conventional production lines.

At the cutting station 108, the continuous wire 101 is engaged and advanced by the driven feed rollers 110 at a first speed $S_1$ to the cutting roller 112. The dedicated feed roller motor 111 is controlled by the controller 128 to achieve the transport speed $S_1$. As explained, at the cutting roller 112, the wire is cut into individual nose wires 102 having a predetermined length. The dedicated cutter roller motor 113 is driven at a rotational rate determined by the controller 138 to achieve the desired length of the nose wires 102. It should thus be appreciated that different nose wire lengths can be cut by the cutting roller 112 (e.g., for different size face masks) for different runs of the production line 106 by varying the speed of the cuter roller 112 relative to the running wire 101 via the controller 128.

The individual nose wires 102 emerging from the cutting roller 112 are engaged by the delivery rollers 116, which advance and deposit the individual nose wires 102 onto the running carrier web 118. The delivery rollers 116 are independently driven by their motor 117 relative to the feed rollers 110 and cutting roller 112 such that the nose wires 102 from the cutting roller 112 are initially accelerated and transported away from the cutting roller 112 at a second speed $S_2$ that is greater than the first speed $S_1$. The individual nose wires 102 are then decelerated by the delivery rollers 116 and moved onto the carrier web 118 at a third speed $S_3$ that is less than the first speed $S_1$ By accelerating and decelerating the individual nose wires 102 in this manner, the throughput of the cutting roller 112 can be maintained, yet the individual nose wires 102 are slowed down for placement onto the carrier web 118 in a more controlled manner than if the nose wires 102 were deposited onto the carrier web 118 at the first speed $S_1$. In other words, the nose wires 102 are not "launched" onto the carrier web hoping that they maintain a desired relative position on the web 118, but are slowed down and laid onto the carrier web 118 in a more controlled manner.

Referring particularly to FIG. 7, it may also be desired to independently drive the roll 104 with its dedicated motor 115 at a fourth speed $S_4$ determined by the controller 128 that is greater than the first speed $S_1$ so as to form an accumulation 138 (e.g. a loop or slack) of the wire 101 between the roll source and the feed rollers. This accumulation 138 prevents drag at the feed rollers and allows precise transport speed of the wire by the feed rollers 110 to the cutting roller 112.

Referring to FIG. 7, for control purposes and to achieve the speed differentials discussed above, the method 100 may further include sensing rotational speed of the feed rollers 110 with a speed sensor 132, and sensing the rotational speed of the delivery rollers 116 with a speed sensor 136, wherein the sensors 132, 136 are also in communication with the controller 128. In addition, a speed sensor 134 may be configured with the cutting roller 112 so as to control the length of the individual nose wires 102, as discussed above. Also, a speed sensor 130 may be configured with the rotationally driven roll 104 of the wire 101 to form the accumulation 128 discussed above.

In order to better control placement of the individual nose wires 102 onto the carrier web 118, it may be desired to control and coordinate the speed of the carrier web 118 with the depositing speed $S_3$ of the roller pair 116 so that a minimal speed differential exists between the two. For this purpose, a web speed sensor 133 (FIG. 7) may be disposed to detect running speed of the web 118 and convey such speed to the controller 128. The controller 128 may be in communication with a drive or supply mechanism associated with the carrier web 118 for controlling the speed thereof as a function of $S_3$.

As mentioned, the present invention also encompasses various system embodiments for cutting and placing individual nose wires in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for cutting and placing individual nose wires in a facemask production line, comprising:

supplying a continuous wire from a supply source to a cutting station in the facemask production line;

at the cutting station, engaging the continuous wire with a set of driven feed rollers and advancing the continuous wire at a first speed to a cutting roller, wherein the continuous wire is cut into individual nose wires by the cutting roller;

engaging the individual nose wires from the cutting roller with a set of delivery rollers to deposit the individual nose wires onto a running carrier web; and wherein the delivery rollers are independently driven relative to the feed rollers and cutting roller such that the individual nose wires from the cutting roller are initially accelerated and transported away from the cutting roller at a second speed that is greater than the first speed and then decelerated and moved onto the carrier web at a third speed that is less than the first speed.

2. The method as in claim 1, wherein the feed rollers are independently driven relative to the cutting roller and the delivery rollers.

3. The method as in claim 2, wherein the cutting roller is independently driven relative to the feed rollers and the delivery rollers.

4. The method as in claim 3, wherein the feed rollers, the cutting roller, and the delivery rollers have independent controllable drives controlled by a controller.

5. The method as in claim 4, wherein the continuous wire is supplied from a driven roll source having a drive that is independent from the feed rollers drive and is controlled by the controller to transport the continuous wire to the feed rollers at a fourth speed that is greater than the first speed so as to form an accumulation of the continuous wire between the driven roll source and the feed rollers.

6. The method as in claim 4, further comprising sensing rotational speed of the feed rollers and the delivery rollers with sensors that are in communication with the controller.

* * * * *